US007131448B2

(12) United States Patent
Lund et al.

(10) Patent No.: US 7,131,448 B2
(45) Date of Patent: Nov. 7, 2006

(54) NAIL CLIPPERS WITH FINGER ILLUMINATOR

(76) Inventors: Tor Rafael Lund, 9648 Barkerville Ave., Whittier, CA (US) 90605; Laurie Kristina Lund, 9648 Barkerville Ave., Whittier, CA (US) 90605

( * ) Notice: Subject to any disclaimer, the term of this patent is extended or adjusted under 35 U.S.C. 154(b) by 0 days.

(21) Appl. No.: 10/660,470

(22) Filed: Sep. 12, 2003

(65) Prior Publication Data

US 2006/0180169 A1 Aug. 17, 2006

Related U.S. Application Data

(60) Provisional application No. 60/411,476, filed on Sep. 17, 2002.

(51) Int. Cl.
*A45D 29/18* (2006.01)

(52) U.S. Cl. ..... 132/73.5; 30/26

(58) Field of Classification Search ..... 132/73, 132/73.5, 73.6, 75, 75.3, 75.4, 75.5; 30/26–28, 30/179, 291; 362/119, 253
See application file for complete search history.

(56) References Cited

U.S. PATENT DOCUMENTS 3,812,868 A * 5/1974 Keating ..... 132/75.4
4,602,430 A * 7/1986 Allen, Jr. ..... 30/28
4,982,747 A * 1/1991 Shah ..... 132/75.5
5,490,327 A * 2/1996 Ohori ..... 30/28
5,678,919 A * 10/1997 Huang ..... 362/119
6,138,360 A * 10/2000 Owens et al. ..... 30/28
6,220,251 B1 * 4/2001 Jeong et al. ..... 132/73.5
6,428,180 B1 * 8/2002 Karram et al. ..... 362/119
6,523,545 B1 * 2/2003 Rende ..... 132/75.5
6,553,592 B1 4/2003 Yang et al.
6,601,587 B1 * 8/2003 Shaw ..... 132/75.3
7,000,321 B1 * 2/2006 Rodgers ..... 30/29
2005/0211030 A1 * 9/2005 Moulton, III ..... 83/13

* cited by examiner

*Primary Examiner*—Cris L Rodriguez
*Assistant Examiner*—Rachel A. Running
(74) *Attorney, Agent, or Firm*—Edgar W. Averill, Jr.; Kenneth L. Green

(57) ABSTRACT

A nail clipping assembly holds a pair of conventional nail clippers in a holder. The holder can also support a light source which is positioned close enough to a subject's finger tip to illuminate the interior of the finger tip. This exposes the intersection between a finger nail which is part of a finger and the exposed nail portion, some or all of which will be cut by the nail clippers.

16 Claims, 2 Drawing Sheets

26

26

46
44
45
43

31
23
33
26
32

26
35
34
33
50
49
51
48
47

NAIL CLIPPERS WITH FINGER ILLUMINATOR

CROSS-REFERENCE TO RELATED APPLICATIONS

The applicants have filed a provisional application on Sep. 17, 2002, application No. 60/411,476.

BACKGROUND OF THE INVENTION

The field of the invention is nail clippers and the invention relates more particularly to an improvement to nail clippers which utilizes a source of light to illuminate the interior of the tip of a subject's finger. A problem exists especially with the cutting of an infant's or toddler's finger nails. The infant or toddler tends to pull away and move in such a way that it is very difficult to accomplish a nail clipping operation. It has been recommended that an infant's or toddler's nails be clipped while the infant or toddler is sleeping. The main difficulties in this approach is that it is typically dark when the infant is sleeping and turning on a light wakes the child.

Even in a brightly illuminated area, the intersection between the portion of the nail which extends beyond the subject's finger and that which is still part of the subject's finger is sometimes difficult to see. Several attempts have been made to illuminate the area of the cutting end of a nail end of a nail clipper. One such device is shown in U.S. Pat. No. 6,553,592, where a pair of LEDs is held outwardly from the end of the nail clipper to illuminate a target place. Another patent showing a light to illuminate the cutting area is U.S. Pat. No. 6,220,251. This device also has a magnifying glass and the light is provided by LED 34. The light and the magnifying glass assist in the viewing of the nail clipping area whether it be for a pet or a human.

By placing the light at a significant distance from the finger nail, the result is the illumination of the exterior surface of the finger tip and nail. Such lighting does not emphasize the line between the finger nail over the finger and the extending part of the finger nail.

BRIEF SUMMARY OF THE INVENTION

The present invention is for a nail clipping assembly including a pair of nail clippers. A light source is held near the upper and lower blades of the nail clippers and positioned so that when a finger is moved so that the nail to be cut is between the blades of the nail cutter, the light source will illuminate the interior of the finger under its nail so that an intersection between the extending portion of the nail and the finger is clearly visible. Preferably, the pair of nail clippers is held in a holder which has a recess for supporting the nail clippers and which also holds batteries and a light bulb or LED. Preferably, the holder has a finger nail guide extending just below the upper blade of the nail clippers. In this way, a subject's finger nail can be raised upwardly until it contacts the finger nail guides and then moved forwardly into the space between the cutting blades of the nail clippers. The present invention also includes the ergonomic handle for holding the nail clippers so that the nail clippers can be supported by the user's palm and fingers instead of just between the fingers, as is done for conventional nail clippers.

DETAILED DESCRIPTION OF THE INVENTION

Figure 1:
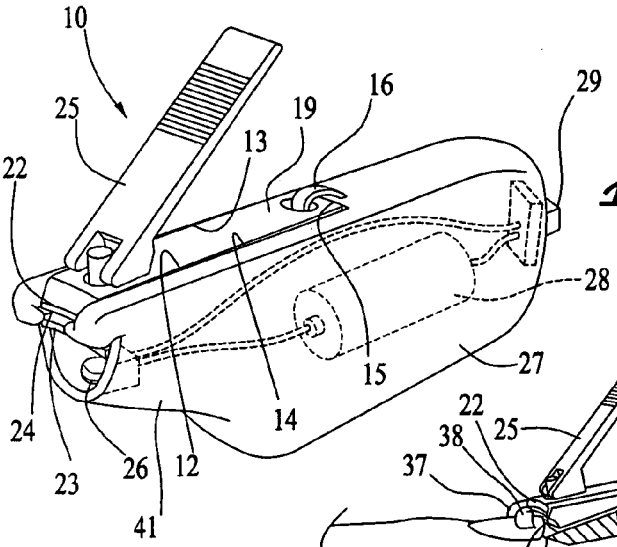
FIG. 1 is a perspective view showing the top, front and left side of the nail clipping assembly of the present invention.

A nail clipping assembly 10 is shown in perspective view in FIG. 1. Assembly 10 holds conventional nail clippers 11 in a recess 12. Recess 12 has side edges 13 and 14 and a back edge 15. Since most conventional nail clippers have a hole near the joined ends of the nail clipper, a tab 16 will extend upwardly from the bottom or floor 17 of recess 12 and pass through the hole 18 in nail clippers 11.

The nail clippers 11 are preferably conventional nail clippers. Such clippers have an upper arm 19 and a lower arm 20. These arms are joined at joined ends 21 typically by a rivet not shown. As is well known, these arms are joined in a way so that an upper blade 22 and a lower blade 23 are spaced apart at the blade end 24 of the nail clippers are spaced apart. An operating lever 25 moves the upper arm downwardly so that upper blade 22 and lower blade 23 contact one another, thereby cutting a finger nail which has been inserted between them.

Figure 2:
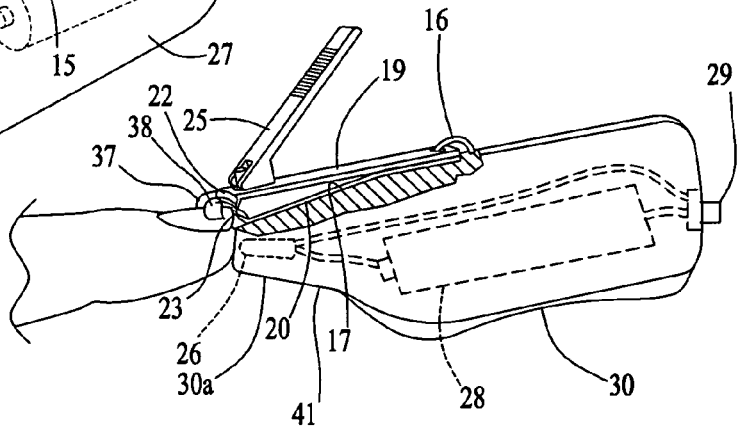
FIG. 2 is a left side view thereof partially cut away.
Figure 3:
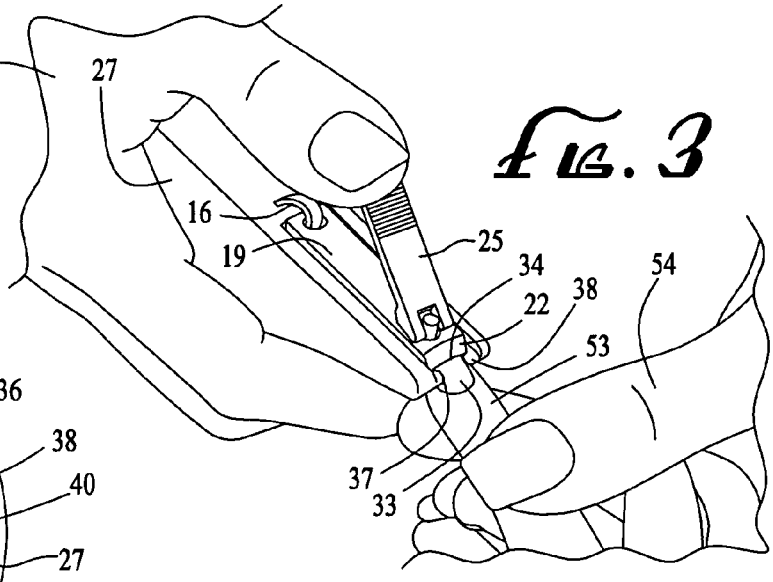
FIG. 3 is a perspective view showing a user cutting a subject's fingernail.

The handle 27 is useful as part of the assembly of the present invention for several reasons. First of all, it makes it much easier to hold nail clippers 11. This is especially useful when trying to cut an infant's finger nails where positioning of the nail clipper is critical. Handle 27 includes a forward portion 30*a*, a transition portion 41, and a hand graspable portion 30, which portions 30*a*, 41, and 30 are preferably rounded. The forward portion 30*a* extends forward approximately to the blades 24, is smaller in cross-section than the hand graspable portion 30, and houses a light source 26, such as a light bulb or LED and a battery 28, as well as associated wiring and a switch 29. The hand graspable portion 30 is large enough to support a user's fingers on one side and palm on the other side. This frees the user's thumb for operation of operating lever 25 in a very comfortable manner. The transition portion 41 transitions between the forward portion 30*a* and the hand graspable portion 30 as shown in FIG. 2, and cooperates with the forward portion 30*a* to provide a resting place for a user's index finger proximal to and just behind the blades 24 as shown in FIG. 3. The portion 41 is preferably a smooth upwardly and forwardly sloping transition between portions 30*a* and 30 to provide a comfortable resting place for the user's index finger. Handle 27 is preferably injection molded and has provisions for opening for replacement of the battery or bulb/LED.

FIG. 3 shows a user holding the handle 27 with the user's right hand 52 and holding a subject's finger 53 with the user's left hand 54. The subject's finger nail 33 is positioned with the aid of guides 37 and 38.

An important feature of the present invention is the presence of light source 26. Light source 26 performs a very different function from the light sources shown in U.S. Pat. Nos. 6,553,592 and 6,220,251. That is, the light source 26 is placed close enough to the finger tip to illuminate the inner portion of the finger tip so that it glows with an orange glow causing the nail ledge to appear dark in color. Most everyone is familiar with the effect of placing a flashlight under the palm of one's hand at night and turning it on. This causes one's hand to glow orange. This same effect is accomplished by light source 26 if it is placed near or touching the tip 31 of finger 32. By the term "near" it is intended to mean a small fraction of an inch such as ⅛ of an inch or less. The fingernail is indicated by reference character 33 in FIG. 5 and that portion of the fingernail which extends beyond the subject's finger is indicated by reference character 34 in FIG. 6. When the light source is placed to cause the finger tip to glow orange, the intersection 35 between that portion of the fingernail 33 over the subject's finger and the extending part of the nail 34 appears much darker and is highly visible. Therefore, the fingernails can be easily and precisely cut in dim light or even in darkness. Light source 26 guides the nail clippers to an appropriate position over the fingernail and once in position, lights the inner portion of the finger tip to facilitate the positioning of the cutting line 36 between upper blade 22 and lower blade 23.

When used to cut the finger nails of an infant or toddler, the device of the present invention, when using a light source near the finger tip, permits the caregiver to cut the infant's or toddler's finger nails at night in dimly lit conditions while the infant or toddler is sleeping without the necessity of turning on the room light or providing any other source of external light. While the above discussion has used the word "finger," it is to be understood that the device can equally be used on toenails.

Figure 4:
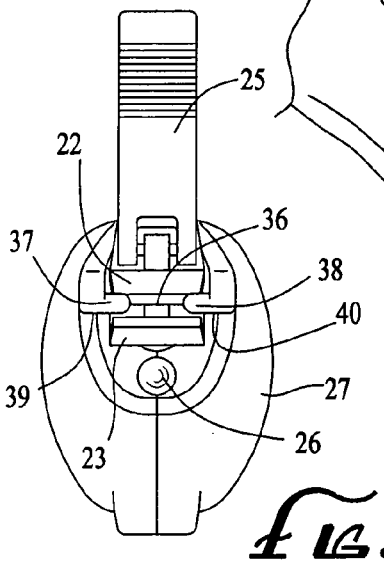
FIG. 4 is a front view thereof.

Another important feature of the present invention is the presence of finger nail guides 37 and 38. These guides have under surfaces 39 and 40, as shown in FIG. 4, which are aligned slightly below the lower edge of upper blade 23. In this way, as shown best in FIG. 3, a subject's finger nail can be brought upwardly until it contacts the under surfaces 39 and 40 and then moved inwardly toward the cutting edges until the clipper is in a desired position. Preferably, the finger nail guides 37 and 38 are separated so that most of the extending part 34 of the finger nail is visible.

Figures 5, 5A, 5B, 6, 7:
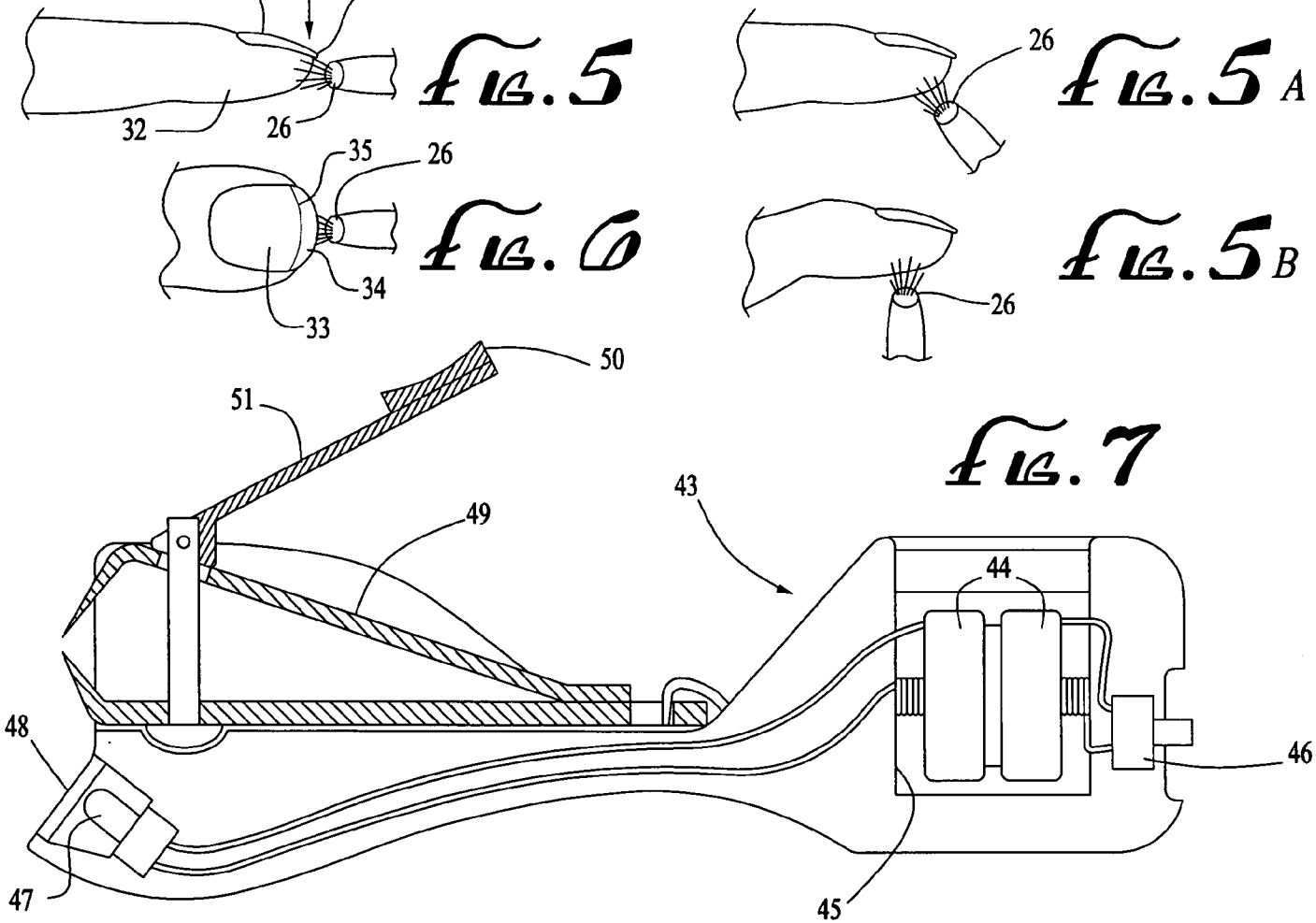
FIG. 5 is a side view of a finger and finger nail together with a light bulb of the nail clipping assembly of the present invention.
FIG. 5A is a side view of a subject's finger and a light source.
FIG. 5B is a side view of a subject's finger and a light source.
FIG. 6 is a top view of FIG. 5.
FIG. 7 is a cross-sectional view of an alternate embodiment of the nail clipping assembly of FIG. 1.

The orientation of the light source 26 is not critical as long as it causes the finger tip to glow orange in subdued light. It may be aligned outwardly from the tip of the finger shown in FIG. 5 or positioned at an angle as shown in FIG. 5A. It could also be placed under the finger as shown in FIG. 5B. It is easy to determine in subdued light whether light placement causes the finger to glow orange or simply lights the external part of the finger. It is generally preferable that the light be below the level of the finger nail.

An alternate embodiment of the nail clipping assembly is shown in FIG. 7 and indicated by reference character 42. This embodiment has a handle 43 including a wafer battery 44 enclosure 45 and a switch 46. A bulb or LED 47 is covered with a lens 48. The nail clippers 49 include a finger rest 50 on operating lever 51. Bulb 47 is aimed toward a finger tip at a 45° angle.

While the device has been shown and described with the presence of a light, the hand graspable handle itself is useful even if the light is not turned on or not used. The ease with which the nail clippers can be positioned is greatly enhanced by handle 30.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

We claim:

1. A nail clipping assembly including a pair of nail clippers for clipping a finger or toe nail, said nail clippers having an upper arm and a lower arm, each arm having a blade end and a joined end and said upper and lower arms being joined at their joined ends and said upper arm having an upper blade at its blade end and said lower arm having a lower blade at its blade end, said upper and lower blades being aligned to meet to form a cutting line and an operating lever held to said pair of nail clippers so that the depression of said operating lever causes said upper blade to move downwardly and meet said lower blade to create a cutting action wherein the improvement comprises:

a holder having a hand graspable portion, a top portion including a nail clipper holding area, a bottom, a back and a cutting end, said holder supporting a light source at its cutting end and said holder having a pair of fingernail guides extending forwardly with respect to said cutting line and positioned so that a bottom edge of each fingernail guide is horizontally aligned between a lowermost portion of said upper blade and an uppermost portion of the lower blade when said nail clippers are oriented horizontally whereby a subject's fingernail is guided into a space between said upper and lower blades.

2. The nail clipping assembly of claim 1 wherein said fingernail guides are horizontally spaced to expose a majority of the subject's fingernail at a line where the fingernail extends outwardly from the subject's finger when the finger is in a cutting position with the finger located in the space between said upper and lower blades.

3. The nail clipping assembly of claim 1 wherein said nail clipper holding area is a recess which extends upwardly from a floor to cover sides of said nail clipper.

4. An ergonomic handle for supporting a nail clipper having an upper arm and a lower arm, each arm having a blade end and a joined end and said upper and lower arms being joined at their joined ends and said upper arm having an upper blade at its blade end and said lower arm having a lower blade at its blade end, said upper and lower blades being aligned to meet to form a cutting line and an operating lever held to said pair of nail clippers so that a depression of said operating lever causes said upper blade to move downwardly and meet said lower blade to create a cutting action, said handle comprising:

a hand graspable handle of sufficient girth and length to permit a user's hand to surround the graspable handle so that the user's palm is on a first side of the handle and a users's fingers grasp the opposite side and the user's thumb extends over a top edge of the hand graspable handle;

a nail clipper recess formed in said top edge and said nail clipper recess being shaped to surround sides of a pair of nail clippers, and having a bottom upon which a pair of nail clippers can rest and a back end portion to prevent the rearward movement of the pair of nail clippers with respect to said handle and the nail clipper recess having an open front end to permit a user to insert a fingernail in a clipping portion of said pair of nail clippers whereby a pair of nail clippers can be easily supported by a user's hand during a nail clipping operation; and wherein said hand graspable handle has a pair of opposed fingernail guides extending inwardly at said open front end and positioned so that when a pair of nail clippers is inserted in said nail clipper recess the opposed fingernail guides extend beyond a front edge of said pair of nail clippers and a bottom edge of each of said opposed fingernail guides is horizontally aligned between a lowermost portion of said upper blade and an uppermost portion of said lower blade of said pair of nail clippers.

5. The ergonomic handle of claim 4 wherein said nail clipper recess has an upwardly extending tab for passing through a hole in a rear end of said pair of nail clippers.

6. The ergonomic handle of claim 4 wherein said hand graspable handle curves upwardly toward its front end.

7. A method for cutting a child's fingernails using finger nail clippers, the method comprising:

turning on a light residing in a forward portion of a handle, the handle supporting said finger nail clippers;

holding a hand graspable portion of the handle between a care giver's fingers and palm;

resting an index finger proximal to and behind blades of the finger nail clippers, on a rest provided by cooperation of the forward portion and a transition portion, the forward portion having a smaller cross-section than the hand graspable portion and the transition portion residing between the forward portion and the hand graspable portion;

positioning the light close to a finger tip;

illuminating an interior of a finger under the finger nail so that the interior of the finger glows, wherein the glowing causes a nail ledge to be distinguishable;

positioning blades of the fingernail clippers to clip the nail ledge from the finger nail; and depressing an operating lever to cut the finger nail.

8. The method of claim 7, wherein illuminating an interior of a finger under the finger nail to visually distinguish a nail ledge comprises illuminating an interior of a finger under the finger nail to cause the nail ledge to appear dark in contrast to the finger tip.

9. A method for cutting a child's fingernails, the method comprising:

turning on a light residing in a forward portion of a handle beneath fingernail clipper blades, the handle supporting finger nail clippers;

holding a hand graspable portion of the handle between the care giver's fingers and palm;

resting the index finger proximal to and behind blades of the finger nail clippers on a rest provided by cooperation of the forward portion and a transition portion, the forward portion having a smaller cross-section than the hand graspable portion and the transition portion residing between the forward portion and the hand graspable portion;

positioning the handle to position the light close to the end of a child's finger having a finger interior;

illuminating the finger interior under the finger nail using the light;

positioning blades of the fingernail clippers to cut the finger nail; and depressing an operating lever to cut the finger nail.

10. The method of claim 9, wherein positioning the handle to position the light close to the end of the child's finger comprises positioning the handle to position the light within ⅛ inch of the end of the child's finger.

11. The method of claim 9, wherein positioning the handle to position the light close to the end of the child's finger comprises positioning the handle close enough to the end of the child's finger to illuminate the interior of the child's finger.

12. The method of claim 11, wherein positioning the handle to position the light close to the end of the child's finger comprises positioning the handle close enough to the end of the child's finger to illuminate the interior of the child's finger and to cause a nail ledge to appear dark in color.

13. The method of claim 9, wherein positioning the handle to position the light close to the end of the child's finger comprises positioning the handle close enough to the end of the child's finger to cause the light to touch the child's finger.

14. The method of claim 9, wherein positioning blades of the fingernail clippers to cut the finger nail comprises:

observing the illuminated finger interior to distinguish a nail ledge; and positioning the blades to based on the observation of the nail ledge.

15. A method for cutting a child's fingernails, the method comprising:

turning on a light residing in a forward portion of a handle beneath fingernail clipper blades, the handle supporting finger nail clippers;

holding the handle in a care giver's hand;

positioning the handle to position the light close to the end of a child's finger having a finger interior;

illuminating the finger interior under the finger nail using the light;

positioning blades of the fingernail clippers to cut the finger nail using at least one guide to assist in positioning the blades of the fingernail clippers to cut the finger nail; and depressing an operating lever to cut the finger nail.

16. The method of claim 15, wherein positioning blades of the fingernail clippers to cut the finger nail comprises using at least one guide to position the blades of the fingernail clippers to cut the finger nail, wherein most of an extending part of the finger nail is observable through the at least one guide.

* * * * *